United States Patent [19]

Pollich

[11] 4,043,548

[45] Aug. 23, 1977

[54] SHEET-CARRYING DISC FOR SHEET TRANSFER DRUMS

[75] Inventor: Gerhard Pollich, Heidelberg, Germany

[73] Assignee: Heidelberger Druckmaschinen Aktiengesellschaft, Heidelberg, Germany

[21] Appl. No.: 680,049

[22] Filed: Apr. 26, 1976

[30] Foreign Application Priority Data

Apr. 25, 1975 Germany ..... 2518334

[51] Int. Cl.[2] ..... B65H 29/20

[52] U.S. Cl. ..... 271/80; 101/420; 226/76; 226/190; 271/275

[58] Field of Search ..... 101/420; 271/80, 82, 271/204, 205, 206, 275, 277; 226/76, 81, 87, 168, 190

[56] References Cited

U.S. PATENT DOCUMENTS

| | | | |
|---|---|---|---|
| 2,965,026 | 12/1960 | Woodward | 101/420 |
| 3,643,598 | 2/1972 | Papa | 101/420 |

*Primary Examiner*—Richard A. Schacher
*Attorney, Agent, or Firm*—Herbert L. Lerner

[57] ABSTRACT

Sheet-carrying disc assembly for a sheet transfer drum carried by a shaft includes a sheet-carrying disc mounted on the drum shaft, a multiplicity of sheet-carrying elements radially adjustable into operative and inoperative positions on the disc, the sheet-carrying elements being constructed as bar-shaped paper carriers disposed at the periphery of the disc, arresting means disposed on the sheet-carrying disc for releasably locking the sheet-carrying elements in the operative and inoperative positions thereof and spring means yieldably biasing the sheet-carrying elements in axial direction of the drum shaft into locking engagement with the arresting means in the operative and inoperative positions of the sheet-carrying elements, each of the bar-shaped paper carriers having a longitudinal axis and being tiltable against the bias of the spring means out of the arresting means about a tilting axis extending in the plane of the sheet carrying disc transversely to the longitudinal axis.

8 Claims, 5 Drawing Figures

SHEET-CARRYING DISC FOR SHEET TRANSFER DRUMS

The invention relates to a sheet-carrying disc assembly for sheet transfer drums having sheet carrier elements which are radially shiftable into an operative position and an inoperative position and which have arresting means which are subjected to spring action and which fix both of the foregoing positions of the sheet carrier elements.

In multicolor rotary printing presses, the sheet to be printed is conveyed by one or more sheet transfer drums from one printing unit to the next during the course of travel thereof. In this process, the carrying peripheral surfaces or supporting devices of these sheet transfer drums may come into contact with wet printed surfaces of the freshly printed sheet, as a result of which the quality of printing may be substantially impaired through set-off or even blurring of the ink which may still be wet.

To obviate these disadvantages, a device has been disclosed in U.S. Pat. No. 2,965,026 wherein, laterally of a substantially flat disc in the shape of a circular arc, segmented portions are disposed which are radially shiftable in a plane parallel to the plane of the disc. To arrest these segmented portions in their inoperative or operative position, as the case may be, it is necessary, however, to provide supplementary arresting means in the form of springloaded ball latches. In spite of the provision of these ball latches, the segmented circular arcuate portions are not held with definiteness in the respective position thereof and secured against radial shift, so that a risk exists that, due to the tension which occurs as the sheet is pulled off the rubber or blanket cylinder, the support elements may be pressed into the inoperative position thereof. Radial shifting of the segmented portions serving as sheet supports by means of pins fastened thereto and projecting laterally therefrom demands adequate spece which can be obtained only by compulsory maintenance of fairly large clearance or spacing between the sheet transfer discs disposed serially or in tandem on the shaft of the guide drum.

German Published Nonprosecuted Application DT-OS 2 002 877 describes a sheet transfer roller for multicolor rotary printing presses which is also provided with adjustable members that serve to support a sheet during the transfer thereof between individual printing units. In that disclosure, the adjustable elements are formed of a plurality of sets of elements having a circular arcuate shape which are slidably and fixably disposed on guides, concentrically to the axis of the roller, and which act at carriers for the sheet support elements per se. The sheet support elements are in the form of substantially rectangular eyes or loops and are disposed laterally in the vicinity of the outer periphery of the circular arcuate elements, movable on a pitch circle thereof, and radially sprung or spring-biased. Adjustment of the sheet support eyes or loops is accordingly effected by lateral swinging or pivoting thereof about the mounted sides thereof through an angle of more than 180°.

Although the disadvantage of imperfect fixing of the sheet support elements of the first-mentioned heretofore known device in the inoperative or operative position thereof, respectively, is eliminated by this last-mentioned heretofore known device, risk arises that if the angle of swing of the sheet support eyes or loops falls short of the angle thereof that is absolutely required, the sheet support eyes or loops will assume a position slightly inclined outwardly towards the carrier elements. As a result, the latter may be forced away outwardly during the rotation of the sheet, even if not into the inoperative position, yet to such an extent that they no longer assume their intended supporting position. It is probably relatively easy to swing the sheet support loops from the operative position thereof into the inoperative position thereof, but much more difficult to lift them up from the inoperative position thereof because they have a rather poor accessiblity, especially if it is necessary to place several sheet transfer segments closely together.

In another sheet transfer drum for multicolor rotary printing presses heretofore known from German Patent DT-PS 1 761 714, sheet support elements with a punctiform support surface are radially adjustably disposed, on circular arcuate segments which are slidable along and fixable on the drum shaft. In addition, the sheet support elements are U-shaped with two arms of unequal length, the long arms thereof, which serve for guidance and mounting, being radially sprung or subject to the bias of compression springs,and the short arms being used for supporting and fixing. By means of the spring force, the sheet support elements are maintained both in the operative as well as the released position thereof.

This last-mentioned device has the disadvantage that adjustment of the sheet support elements is extremely complicated and may thereby be performed only with a great sacrifice of time. Indeed, to bring them from the released position thereof into the operative position thereof, it is necessary to lift the short arms thereof out of arresting holes against the action of the compression springs, rotate them through an arc of 90° about the long arms thereof and lower them again into an arresting groove. The changeover must thus be carried out with care and, depending upon the strength of the compression springs, with the use of the entire hand. The large radius of swing about the long arms requires the maintenance of given minimal clearance or spacing between the individual sheet support elements and furthermore, the construction of the circular arcuate segments, which carry the sheet support elements, with a corresponding width.

Starting from this state of the art, an object of the invention of the instant application is to provide a sheet-carrying disc assembly for sheet transfer drums wherein the sheet-carrying elements, through readily accessible disposition thereof on the supporting disc, can be adjusted relatively simply, with little expenditure of energy and in the shortest possible time, both into the inoperative and the operative position thereof, and the sheetcarrying elements are disposed positively or formlockingly in these positions due to loading or stressing in radial direction.

With the foregoing and other objects in view, there is provided, in accordance with the invention, a sheet-carrying disc assembly for a sheet transfer drum carried by a shaft comprising a sheetcarrying disc mounted on the drum shaft, a multiplicity of sheetcarrying elements radially adjustable into operative and inoperative positions, on the disc the sheet-carrying elements being constructed as bar-shaped paper carriers disposed at the periphery of the disc, arresting means disposed on the sheet-carrying disc for releasably locking the sheet-carrying elements in the operative and inoperative position thereof, and spring means yieldably biasing the sheetcarrying elements in axial direction of the drum shaft into locking engagement with the arresting means in the operative and inoperative positions of the sheet-carrying elements, each of the bar-shaped paper carriers having a longitudinal axis and being tiltable against the bias of the spring means out of the arresting means about a tilting axis extending in the plane of the sheet-carrying disc transversely to the longitudinal axis.

The disposition of the paper carriers provides ease of operation and ensures rapid and time-saving adjustment, since the paper carriers are shiftable by a slight pressure of the finger both into the operative as well as the inoperative position thereof.

Due to the automatic arresting of the paper carriers the disposition of additional arresting means is superfluous, and the risk of incorrectly executed or incomplete change-over of the paper carriers is eliminated. The arresting device furthermore offers the advantage that the paper carriers are not shiftable again due to radial pressure alone, so that the risk of accidental engagement or insertion thereof into the inoperative position through the tension resulting from pulling the sheet off the rubber cylinder is eliminated.

In accordance with another feature of the invention the sheetcarrying disc comprises a supporting disc and a spring ring secured thereto, the bar-shaped carriers being radially slidably disposed therebetween and being subjectible to a spring-biasing force of the spring ring when being adjusted between the operative and inoperative positions thereof. Good guidance for the paper carriers is thereby attained as they are sliding. Furthermore, the necessity of spring-biasing th paper carriers, or of constructing them as resilient self-biasing parts is dispensed with.

In accordance with a further feature of the invention, the spring ring is formed at the periphery thereof with a multiplicity of radially extending, substantially rectangular recesses defined by slotted walls formed as spring elements and having a resilience acting in a direction so as to serve for radially guiding the barshaped carriers during adjustment thereof and for axially arresting and yieldably biasing the bar-shaped carriers in the operative and inoperative positions thereof. Automatic locking into place and simultaneous axial arresting of the paper carriers are thereby achieved.

In accordance with an added feature of the invention, the sheetcarrying disc includes compression spring means received in the radially extending recesses formed in the spring ring and disposed at the end of the bar-shaped paper carriers facing radially inwardly so as to return bias the bar-shaped paper radially from the inoperative to the operative position thereof.

In accordance with an additional feature of the invention, the barshaped paper carriers, after being tilted about the tilting axis, being shiftable in an inclined position relative to the axial direction of the drum shaft and in a direction toward the supporting disc.

In accordance with yet another feature of the invention, the barshaped carriers are formed with a rectangular cross section and have, on the side thereof facing the supporting disc, a stop collar extending circumferentially to the axis of the drum shaft, as well as a similarly extending drop-in collar, both of the collars ensuring locking of the bar-shaped paper carriers in the operative and inoperative positions thereof, the stop collar being operatively connectible with an exterally disposed wall defining a recess formed in the supporting disc, the arresting means comprising a pair of arrest members formed on the supporting disc, and the drop-in collar being operatively connectible with the arrest members.

As a result of the two last-mentioned features of the invention, it is impossible for the paper carriers, during rotation of the transfer drum, either to be flung outwardly due to the centrifugal forces which are produced or to be forced inwardly due to the tension of the sheet.

In accordance with yet a further feature of the invention, one of the arrest members is an arresting groove formed in the support disc for receiving the drop-in collar therein so as to lock the respective bar-shaped paper carrier in inoperative position thereof, and the other of the arrest members is the peripheral surface of the supporting disc for engaging the drop-in collar so as to lock the respective bar-shaped paper carrier in operative position thereof.

In accordance with a concomitant feature of the invention, the barshaped paper carriers are formed at the paper-carrying end thereof In accordance with a concomitant feature of the invention, the bar-shaped paper carriers are formed at the paper-carrying end thereof with surfaces angular in cross section and intersecting to form paper-supporting edges, the edges extending concentrically to the axis of the drum shaft and having a radius.

Other features which are considered as characteristic for the invention are set forth in the appended claims.

Although the invention illustrated and described herein as embodied in a sheet-carrying disc for sheet transfer drums, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
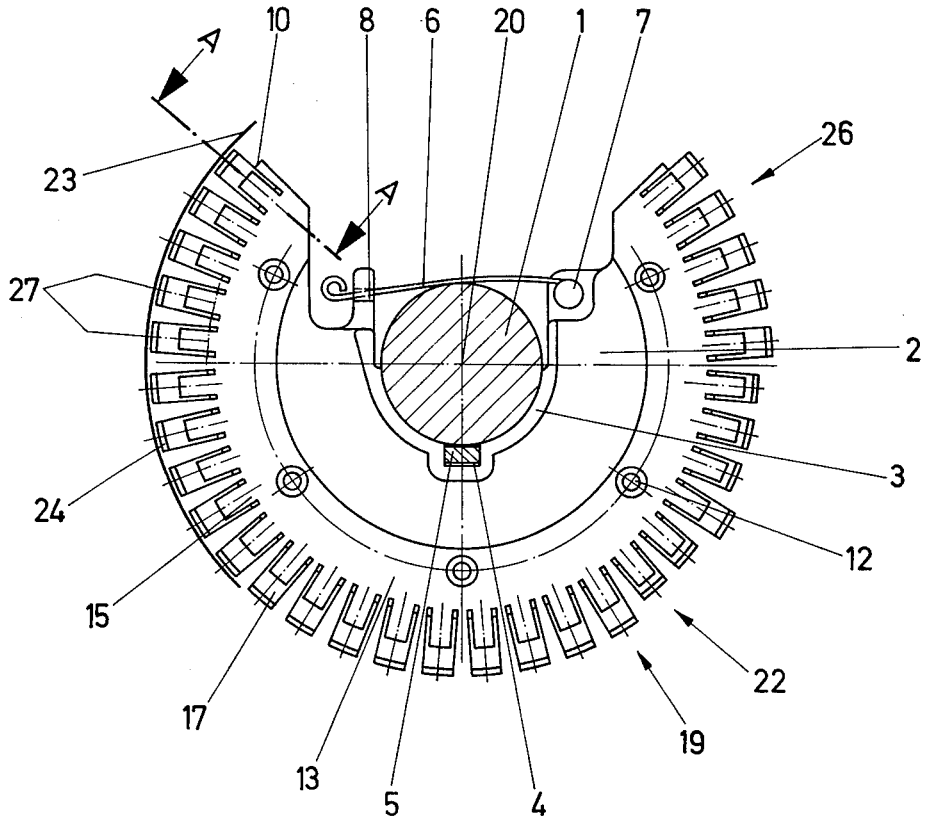
FIG. 1 is a front elevational view of a sheet-carrying disc according to the invention with various paper carriers in operative and inoperative position.

Referring now to the drawing and first, particularly, to FIG. 1 thereof, there is shown disposed on a shaft 1 of a sheet transfer drum so as to be axially slidable and fixable thereon, a number of supporting discs 2 shaped as arcuate segments of a circle, provided with semicircular guides 3. Formed in the semicircular guides 3 are fitting grooves 4 which there engages a fitting key 5, that is inserted in the shaft 1, thereby preventing the supporting discs 2 from twisting.

The supporting discs 2 are fastened to the shaft 1 by way of tension springs 6 which are mounted on one extended or lengthened side of the semicircular guides 3 so as to be movable about pins 7. The other side of the semicircular guides 3, likewise extended, is provided with catches 8 under which the tension springs 6 engage in stressed or taut condition.

Figure 2:
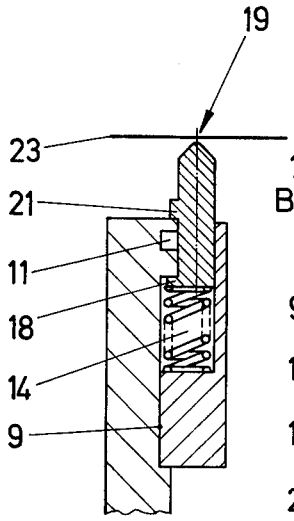
FIGS. 2, 3 and 4 are enlarged cross-sectional views of FIG. 1 taken along the line A—A in the direction of the arrows and showing the paper carrier, respectively in the operative position thereof, in the inoperative position thereof, and during adjustment thereof.
Figure 3:
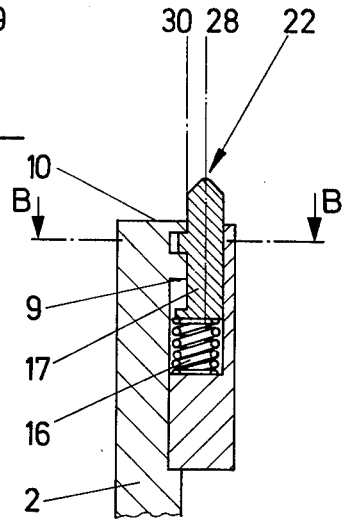
Figure 4:
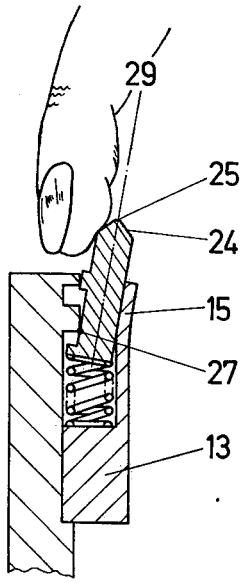

As shown in FIGS. 2 to 4, the front end of each supporting disc 2 is formed with a recess 9 and, between this recess 9 and the peripheral surface 10 of the supporting disc 2 in the vicinity of the outer periphery thereof, with an arresting groove 11.

Figure 5:
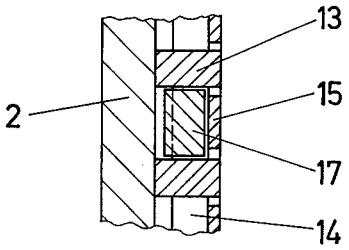
FIG. 5 is a sectional view of FIG. 3 taken along the line B—B in the direction of the arrows.

Single or multipartite spring rings 13 are fixed to the supporting discs 2 in the recesses 9 by means of screws 12 in such a manner that the periphery thereof coincides with that of the supporting discs 2. As shown in FIG. 5, formed in the outer periphery of the spring rings 13 at selective intervals is any desired number of radial, rectangular recesses 14, the base surface of which extends horizontally, as viewed in FIGS. 2 to 4. Thus, in the region of these recesses 14, there remain only thin external walls of the respective spring ring 13 which, at the lateral surfaces defining the recesses 14, are slotted to approximately two-thirds of the depth and are thereby subdivided into elastic spring elements 15.

Received in the recesses 14 of the spring rings 13, that are screwed onto the supporting discs 2, are compression springs 16 for which the recesses 14 thus act as a spring cage. In this connection, the compression springs 16 are guided by the lateral surfaces defining the recesses 14 and also by the spring elements 15 thereof and the supporing discs 2. Above the compression springs 16, as viewed in FIGS. 2 and 4, bar-shaped paper carriers 17 are inserted in the recesses 14. The bar-shaped paper carriers 17 have a substantially rectangular cross section and having a horizontal base surface, as viewed in FIGS. 2 to 4. Each of the paper carriers 17 is provided, on the side thereof facing the supporting disc 2, with a stop collar 18 at the lower end thereof, as viewed in FIGS. 2 to 4, the upper side of the stop collar 18, in the operative position of the paper carrier 17 shown in FIG. 2, abutting the externally disposed wall defining the recess 9 of the supporting disc 2. Thus, the stop collar 18 acts as a protection for the operative position of the paper carriers 17, as indicated by the arrow 19 in FIG. 2, to ensure that, during adjustment, the paper carriers 17 cannot slip out of the recesses 14 under the action of the compression springs 16 or under the action of the centrifugal force exerted by the rotating sheet transfer drum.

Each of the paper carriers 17 has, moreover, on the side thereof facing the supporting disc 2, a detent or drop-in collar 21 extending concentrically with the drum axis 20 which, in the operative position 19 (FIG. 2) of the paper carrier 17, comes to rest on the peripheral surface 10 of the associated supporting disc 2 and, in the inoperative position of the paper carrier 17, as indicated by the arrow 22 in FIG. 3, engages in the arresting groove 11 of this supporting disc 2. On the one hand, due to the fact that the drop-in collar 21 of the paper carriers 17, in the operative position 19 of the latter, rests on the peripheral surfaces 10 of the supporting discs 2, the paper carriers 17 cannot be pushed into their inoperative position 22 through the tension resulting from the pulling of the sheet 23 off the rubber cylinder while the machine is running and on the other hand, the paper carriers 17, in the inoperative position thereof, cannot be forced out of the operative position 19 thereof by the action of the compression springs 16 or the centrifugal forces occurring during rotation of the sheet transfer drum, due to the arresting of the drop-in collar 21 in the respective arrest groove 11.

The surfaces 24 forming the support edges 25 of the paper carriers 17 are angular in cross section. The support edges 25 per se thus also extend concentrically to the drum axis 20 and are formed with a radius at the tips thereof.

The hereinaforedescribed device is adjusted in the following manner:

To move the paper carriers 17 of the sheet-carrying disc 26 from the operative position 19 thereof into the operative position 22 thereof they are first titled about a tilting axis 27 which extends transversely to the longitudinal axis 28 thereof in the place 30 of the sheet carrying disc 26 at the edge of the externally disposed wall defining the recess 9. The tilting of the paper carriers 17 is effected by finger pressure applied to the support edges 25 against the force of the spring elements 15 to an extent that the paper carriers 17 are tilted out of the plane 28 thereof when in operative and inoperative positions, so that the lower surface of the drop-in collar 21 is no longer resting on the peripheral surface 10. With the paper carrier 17 in this consequently inclined position 29 (FIG. 4) thereof, its drop-in collar 21 can no longer check any shift directed radially relative to the drum axis 20.

Starting from this inclined position 29, the paper carriers 17 are then slid in by gentle radial pressure. The sliding movement does not occur in a plane parallel to the supporting disc 2, but rather in a plane disposed at an acute angle to the supporting disc 2. When the inoperative position 22 is reached, the drop-in collar 21 of the paper carriers 17 automatically engages in the arresting groove 11 of the supporting disc 2 due to the spring action of the spring elements 15 directed against the respective supporting disc 2, the paper carriers 17 being thereby again arrested so as to prevent radial shifting thereof during operation of the machine.

Adjustment of the paper carriers 17 from the inoperative position 22 thereof into the operative position 19 thereof occurs in the same sequence except that the paper carriers 17 are pressed radially outwardly due to the force of the compression springs 16 until the upper side of the stop collar 18 thereof, as viewed in FIGS. 2 to 4, abuts the outer margin of the recess 9 in the supporting disc 2, thereby preventing any farther shift of the paper carriers 17. Simultaneously, the drop-in collar 21 of the paper carriers 17 assumes a position on the peripheral surface 10 of the associated supporting disc 2.

As noted hereinbefore, the invention is obviously not restricted to the embodiments represented in FIG. 1 to 5 and described herein, but may include within the scope thereof the most varied modifications with regard to structural details, such as the construction of the supporting disc 2 and of the spring ring 3, the shape of the paper carriers 17, the choice of spring means, for example.

There are claimed:

1. Sheet-carrying disc assembly for a sheet transfer drum carried by a shaft comprising a sheet-carrying disc mounted on the drum shaft, a multiplicity of sheet-carrying elements radially adjustable into operative and inoperative positions on said disc, said sheet-carrying elements being constructed as bar-shaped paper carriers disposed at the periphery of said disc, arresting means disposed on said sheet-carrying disc for releasably locking said sheet-carrying elements in said operative and inoperative positions thereof, first spring means yieldably biasing said sheet-carrying elements in axial direction of the drum shaft into locking engagement with said arresting means in said operative and inoperative positions of said sheet-carrying elements, each of said bar-shaped paper carriers having a longitudinal axis and being tiltable against the bias of said spring means out of said arresting means about a tilting axis extending in the plane of said sheet carrying disc transversely to said longitudinal axis, and second spring means yieldably biasing said sheet-carrying elements in radial direction of the drum shaft.

2. Sheet-carrying disc according to claim 1 wherein said barshaped paper carriers are formed at the paper-carrying end thereof with surfaces angular in cross section and intersecting to form paper-supporting edges, said edges extending concentrically to the axis of the drum shaft and having a radius.

3. Sheet-carrying disc assembly for a sheet transfer drum carried by a shaft comprising a sheet-carrying disc mounted on the drum shaft, a multiplicity of sheet-carrying elements radially adjustable into operative and inoperative positions on said disc, said sheet-carrying elements being constructed as bar-shaped paper carriers disposed at the periphery of said disc, arresting means disposed on said sheet-carrying disc for releasably locking said sheet-carrying elements in said operative and inoperative positions thereof, and spring means yieldably biasing said sheet-carrying elements in axial direction of the drum shaft into locking engagement with said arresting means in said operative and inoperative positions of said sheet-carrying elements, each of said bar-shaped paper carriers having a longitudinal axis and being titable against the bias of said spring means out of said arresting means about a tilting axis extending in the plane of said sheet carrying disc transversely to said longitudinal axis, said sheet-carrying disc comprising a supporting disc and a spring ring secured thereto, said bar-shaped paper carriers being radially slidably disposed therebetween and being subjectible to a spring-biasing force of said spring ring when being adjusted between said operative and inoperative positions thereof.

4. Sheet-carrying disc assembly according to claim 3 wherein said spring ring is formed at the periphery thereof with a multiplicity of radially extending, substantially rectangular recesses defined by slotted walls formed as spring elements and having a resilience acting in a direction so as to serve for radially guiding said bar-shaped paper carriers during adjustment thereof and for axially arresting and yieldably biasing said bar-shaped paper carriers in the operative and inoperative positions thereof.

5. Sheet-carrying disc according to claim 4 including compression spring means received in said radially extending recesses formed in said spring ring and disposed at the end of said bar-shaped paper carriers facing radially inwardly so as to return bias said bar-shaped paper carriers radially from said inoperative to said operative position thereof.

6. Sheet carrying disc according to claim 4 wherein said bar-shaped paper carriers, after being tilted about said tilting axis, are shiftable in an inclined position relative to the axial direction of the drum shaft and in a direction toward said supporting disc.

7. Sheet-carrying disc according to claim 4 wherein said bar-shaped paper carriers are formed with a rectangular cross section and have, on the side thereof facing said supporting disc, a stop collar extending circumferentially to the axis of the drum shaft, as well as a similarly extending drop-in collar, both of said collars ensuring locking of said bar-shaped paper carriers in said operative and inoperative positions thereof, said stop collar being operatively connectible with an externally disposed wall defining a recess formed in said supporting disc, said arresting means comprising a pair of arrest members formed on said supporting disc, and said drop-in collar being operatively connectible with said arrest members.

8. Sheet-carrying disc according to claim 7 wherein one of said arrest members is an arresting groove formed in said support disc for receiving said drop-in collar therein so as to lock the respective bar-shaped paper carrier in inoperative position thereof, and the other of said arrest members is the peripheral surface of said supporting disc for engaging said drop-in collar so as to lock the respective bar-shaped paper carrier in operative position thereof.

* * * * *